US008727451B2

(12) United States Patent
Fader et al.

(10) Patent No.: US 8,727,451 B2
(45) Date of Patent: May 20, 2014

(54) ROTATABLE GRADING PICK WITH DEBRIS CLEARING FEATURE

(75) Inventors: Joseph Fader, Graz (AT); Kenneth Monyak, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 80 days.

(21) Appl. No.: 13/189,767

(22) Filed: Jul. 25, 2011

(65) Prior Publication Data

US 2012/0025591 A1 Feb. 2, 2012

Related U.S. Application Data

(60) Provisional application No. 61/369,836, filed on Aug. 2, 2010.

(51) Int. Cl.
*E21C 35/19* (2006.01)
*E21C 35/197* (2006.01)

(52) U.S. Cl.
USPC ..... 299/107; 299/103; 299/110

(58) Field of Classification Search
USPC ..... 299/79.1, 85.2, 100–11, 112 R, 112 T, 299/113, 100–111; 37/452, 454, 455; 172/713, 753
See application file for complete search history.

(56) References Cited

U.S. PATENT DOCUMENTS

| | | | | |
|---|---|---|---|---|
| 3,841,709 | A * | 10/1974 | Kniff | 299/101 |
| 3,945,681 | A * | 3/1976 | White | 299/107 |
| 5,007,685 | A * | 4/1991 | Beach et al. | 299/85.2 |
| 5,799,741 | A | 9/1998 | Kosobrodov et al. | |
| 6,354,771 | B1 | 3/2002 | Bauschulte et al. | |
| 7,475,949 | B2 * | 1/2009 | Helsel et al. | 299/108 |
| 2007/0257545 | A1 * | 11/2007 | Mouthaan et al. | 299/107 |
| 2008/0164748 | A1 * | 7/2008 | Hall et al. | 299/104 |
| 2009/0261646 | A1 * | 10/2009 | Ritchey et al. | 299/106 |
| 2011/0109147 | A1 * | 5/2011 | Monyak et al. | 299/29 |

FOREIGN PATENT DOCUMENTS

| | | |
|---|---|---|
| DE | 3401243 | 8/1984 |
| DE | 3844297 | 10/1989 |
| WO | WO 2005/088073 | 9/2005 |
| WO | WO 2010/027315 | 3/2010 |

OTHER PUBLICATIONS

International Search Report for International Application No. PCT/SE2011/050580, dated Nov. 14, 2011.

* cited by examiner

*Primary Examiner* — Sunil Singh
(74) *Attorney, Agent, or Firm* — Morgan, Lewis & Bockius LLP

(57) ABSTRACT

A rotatable grading pick has a head portion, a shank portion extending rearwardly from the head portion, and a polygonal portion on the rotatable grading pick. At least a portion of the outer perimeter of the polygonal portion can be engaged by a tool so that the polygonal portion can be rotated, and the shank portion can be rotated to clear debris between the shank portion and a retainer placed around a part of the shank portion.

14 Claims, 12 Drawing Sheets

ROTATABLE GRADING PICK WITH DEBRIS CLEARING FEATURE

FIELD

The present disclosure relates to a rotatable grading pick with a debris clearing feature. More particularly, the present disclosure relates to a rotatable grading pick with a polygonal-shaped portion adapted for engaging with a tool that can rotate the rotatable grading pick.

BACKGROUND

In the discussion of the background that follows, reference is made to certain structures and/or methods. However, the following references should not be construed as an admission that these structures and/or methods constitute prior art. Applicants expressly reserve the right to demonstrate that such structures and/or methods do not qualify as prior art.

Road grading machines include one or more rotatable grading picks that rotate during operation. A retainer is positioned about a portion of each grading pick to retain the grading pick in a holder that allows the grading pick to rotate when the road grading machine is in operation. A tip portion of each grading pick then contacts the surface of the road and rotates to grade the surface.

Continuous rotation of the grading pick during operation is essential to maximize the life of the grading pick. During operation, debris, such as fines, dusts, grit, pebbles, dirt, and the like, is produced that can settle between the grading pick and its retainer. In particular, when the road grading machine is not in operation, such as when the machine is stopped between shifts, the debris from the grading process can accumulate between the retainer and a portion of the grading pick. The debris can then become packed and hamper rotation of the grading pick. If enough debris accumulates, the grading pick can stop rotating which can lead to premature failure of the grading pick. Thus, before operation of the machine resumes, an operator must manually loosen the grading pick by manually rotating each grading pick to loosen the fines that have become lodged in the gap. However, manually rotating each grading pick is extremely time consuming, and thus, the road grading machine cannot be immediately returned to operation. Therefore, some operators avoid manually rotating some or all of the grading picks so that the road grading machine can be returned to operation sooner, thereby dramatically shortening the expected life of the grading pick.

Accordingly, there is a need in the art for a grading pick that can be quickly and more easily rotated by an operator.

SUMMARY

An exemplary rotatable grading pick comprises a head portion, a shank portion extending rearwardly from the head portion, and a polygonal portion disposed on the rotatable grading pick.

An exemplary tool and block assembly comprises a block including a body having a bore extending axially from a first side to a second side, and a grading pick rotatably mounted in the bore of the block. The grading pick includes a head portion, a shank portion extending rearwardly from the head portion, and a polygonal portion disposed on the grading pick.

An exemplary road grading machine comprises a tool and block assembly, and a grading pick rotatably mounted to the tool and block assembly. The grading pick includes a head portion, a shank portion extending rearwardly from the head portion, and a polygonal portion disposed on the grading pick.

It is to be understood that both the foregoing general description and the following detailed description are exemplary and explanatory and are intended to provide further explanation of the invention as claimed.

BRIEF DESCRIPTION OF THE DRAWINGS

The following detailed description can be read in connection with the accompanying drawings in which like numerals designate like elements and in which.

DETAILED DESCRIPTION

Figure 1:
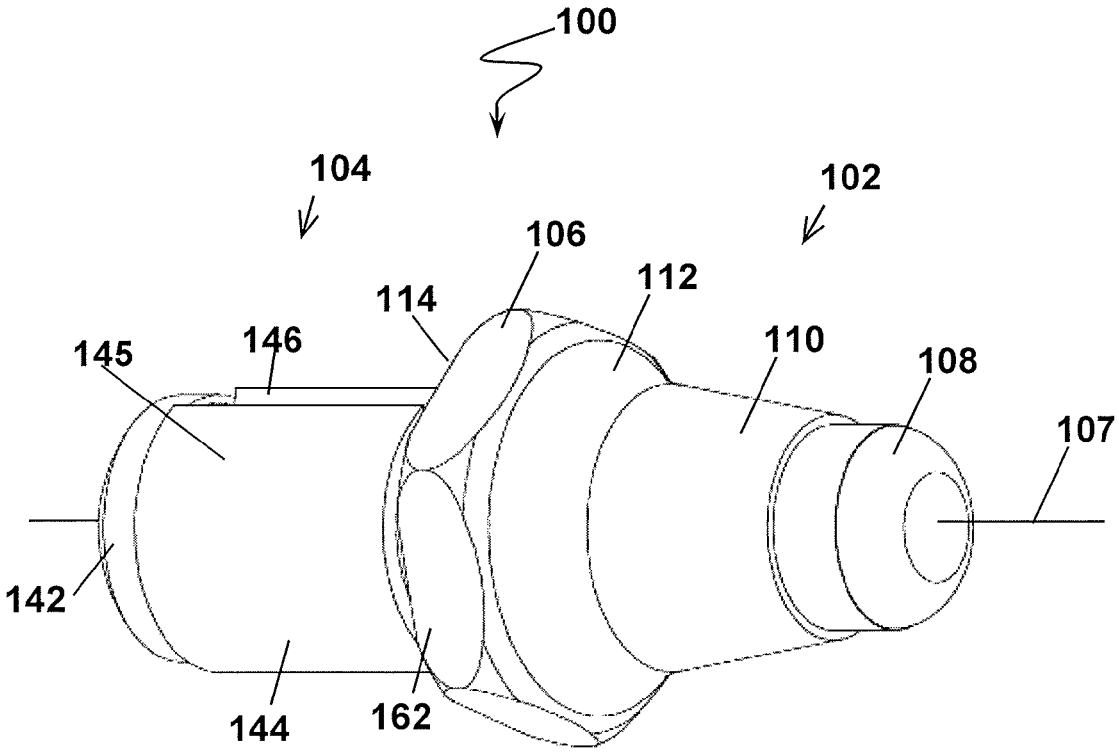
FIG. 1 is a perspective view of a rotatable grading pick in accordance with an exemplary embodiment of the invention.
Figure 2:
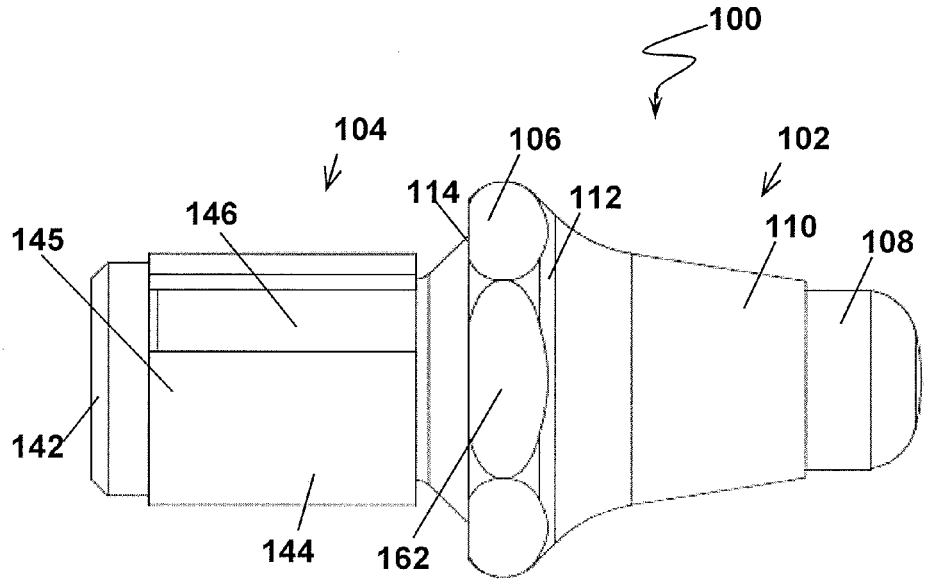
FIG. 2 is a plan view of the rotatable grading pick shown in FIG. 1.
Figure 3:
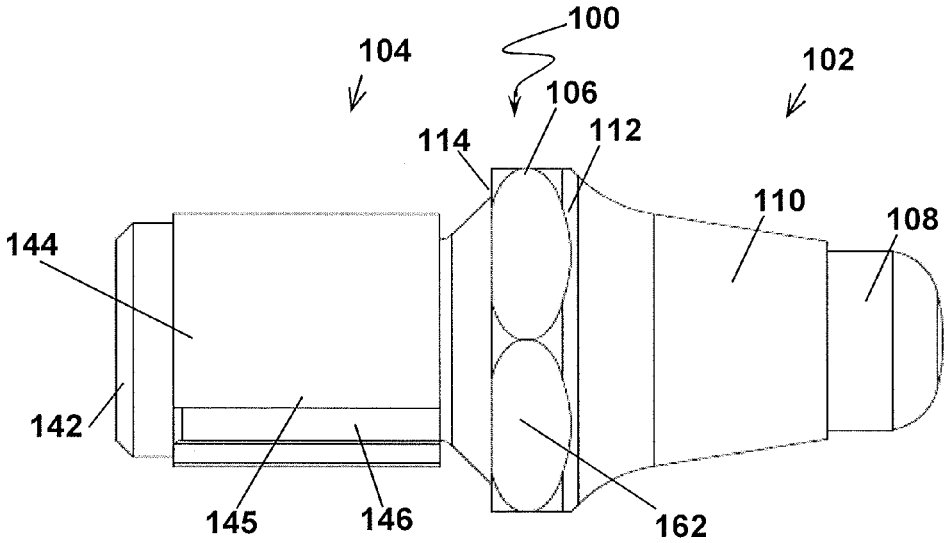
FIG. 3 is another plan view of the rotatable grading pick shown in FIG. 1.

An exemplary grading pick 100 according one embodiment of the invention is shown in FIGS. 1-5. The exemplary grading pick 100 can include a head portion 102 and a shank portion 104 extending from the head portion 102. The exemplary grading pick 100 can also include a polygonal portion 106. A tool, such as a hand wrench, a pneumatic wrench, a crescent-type wrench, a combination wrench, a socket for a wrench, or some other tool that can engage the polygonal portion 106 may engage at least a portion of an outer perimeter of the polygonal portion 106 so that the polygonal portion 106 can be rotated. For example, the grading pick 100 and a tool that engages the grading pick 100 can be rotated about an axis 107 shown in FIG. 1. When the polygonal portion 106 is rotated, a portion of the grading pick 100, such as the shank portion 104, can also rotate, and thus debris that has accumulated between the grading pick 100 and a retainer 144 adapted to hold the grading pick 100 can be substantially loosened. The polygonal portion 106 simplifies and thus makes it easier for an operator to rotate one or more grading picks 100 mounted on a board or holder 300 (shown in FIGS. 11-16) before resuming operation of a road grading machine that is coupled to the holder 300. Thus, the operator is more likely rotate the grading pick 100 thereby extending the life of the grading pick 100.

While the grading pick 100 is generally suitable for use as part of the road grading machine and described in reference to the road grading machine, it should be understood that the grading pick 100 is applicable to tools other than the road grading machine, such as mining and trenching tools.

Figure 18A:
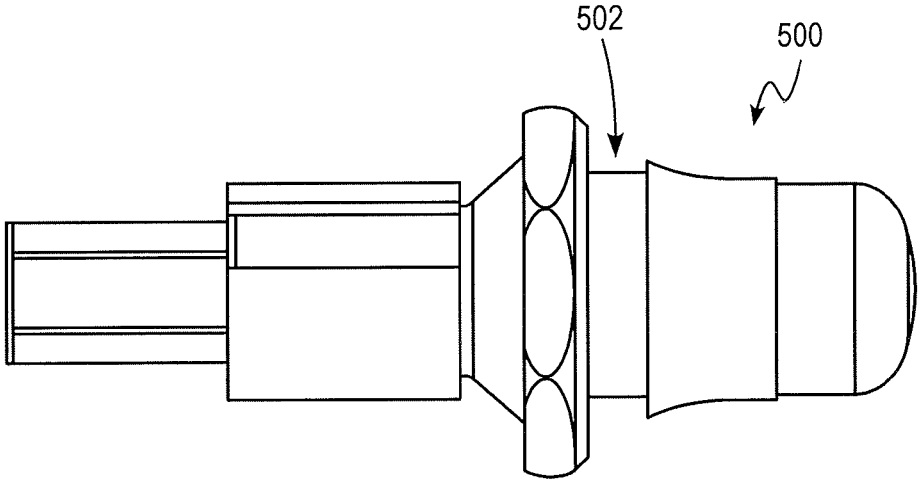
FIGS. 18A and 18B are perspective views of a rotatable tool grading in accordance with a further exemplary embodiment of the invention.

Referring to FIGS. 1-4, the head portion 102 can include any suitable features, including, for example, a tip 108, a side surface 110, and a shoulder region 112. The tip 108 can be disposed at the front of the head portion 102, while the shoulder region 112 can be at the opposite end of the head portion 102. The term "front" is not meant to limit the invention but is instead used herein to facilitate the description of the relative positions of parts of the grading pick 100. Between the tip 108 and the shoulder region 112, the head portion 102 can include a side surface 110 that can extend between the tip 108 and the shoulder region 112. The side surface 110 can be of various forms, including, but not limited to, being substantially parallel to the axis 107, having an angle relative to the axis 107, planar, concave, convex, or combinations thereof. The side surface 110 can also include a reduced diameter portion or a puller groove 502 (See grading pick 500 in FIG. 18A) or a groove that can be engaged with another tool, such as an extractor tool, to pull the grading pick 100 from the road grading machine.

The tip 108 can be adapted to bore or wear down the surface of the road when the grading pick 100 is rotated. The tip 108 can be formed integrally with the head portion 102 or made separately and then mechanically coupled to the head portion 102. If the tip 108 is formed separately, the head portion 102 can include a seat for receiving the tip 108 therein at a front end of the head portion 102. The tip 108 can be made from a suitably hard material, such as tungsten carbide or cemented carbide, such as 6-12 wt. % Co with the balance being WC.

Figure 18B:
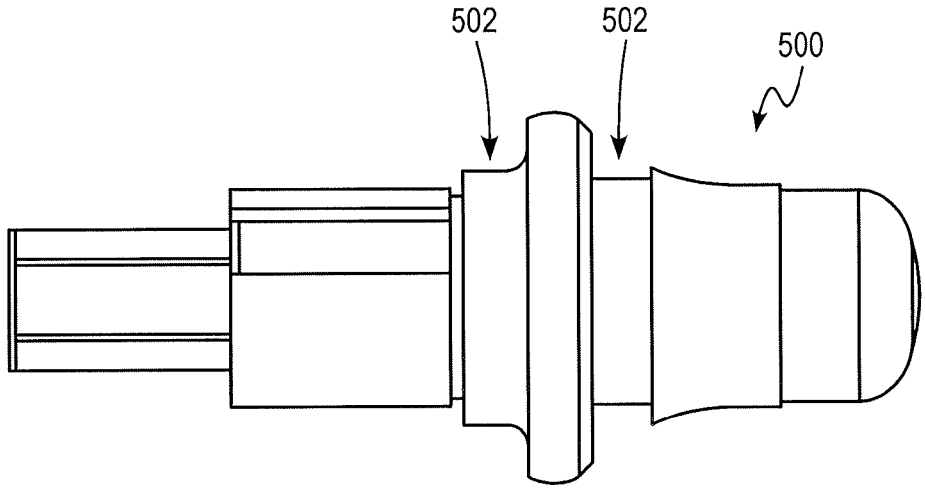

The shoulder region 112 can provide a rearward facing surface 114 from which the shank portion 104 extends. The term "rearward" is not meant to limit the invention but is instead used herein to facilitate the description of the relative positions of parts of the grading pick 100. The shoulder region 112 can include the polygonal portion 106 or a puller groove 502 (See grading pick 500 in FIG. 18B) in place of or in addition to a puller groove on the side surface 110.

In the embodiment shown in FIGS. 1-5, because the outermost perimeter of the shoulder region 112 can be larger that an outermost perimeter of the tip 108, the side surface 110 can taper rearwardly to the shoulder region 112 at an angle with respect to the axis 107. Also, in the embodiment shown in FIGS. 1-5, the shoulder region 112 can include the polygonal portion 106.

Referring to FIGS. 1-3 and 5, the shank portion 104 extends rearwardly from the head portion 102. In alternate embodiments, a part of the shank portion 104 immediately adjacent to the shoulder region 112 may have an enlarged diameter portion that can be used as a washer seat. In other embodiments, the shank portion 104 may include a reduced diameter portion for accommodating a reduced diameter portion of a retaining element or for receiving a washer. The shank 104 can include additional features, such as an annular recess, a circumferential channel, or some other depression that can be used for retaining the grading pick 100 or for receiving another component or tool.

In the embodiment shown, the shank portion 104 can extend from the surface 114 of the shoulder region 112. The shank portion 104 can include an end 142 that is at a distal end of the grading pick 100 opposite the tip 108. A retainer 144 can be disposed substantially between the end 142 of the shank portion 104 and the rear surface 114 of the shoulder region 112. As depicted, the shank portion 104 can include an enlarged diameter portion disposed at the rear of the grading pick 100 near or at the end 142. The diameter of the enlarged diameter portion can be larger than an inner diameter of the retainer 144 so that the shank portion 104 restrains the retainer 144. In other embodiments, the shank portion 104 can include tabs, bumps, convex portions, concave portions, or some other interlocking mechanical parts so that retainer 144 is coupled with the shank portion 104.

The retainer 144 can be adapted to retain the grading pick 100. The retainer 144 can also be adapted to allow the grading pick 100 to rotate. The retainer 144 may not be in friction fit contact with the shank portion 104 of the grading pick 100. However, the retainer 144 can be mated to the shank portion 104 to limit axial movement and can include a retaining feature for retaining the grading pick 100. The retainer 144 can include a spring member 145 that provides the retainer 144 with an uncompressed diameter or free diameter. The retainer 144 can also have an axial length and a thickness. In the embodiment shown, the retainer 144 can have a generally cylindrical, tubular form with a hollow extending through the retainer 144. The hollow of the retainer 144 can be sized to substantially envelope the shank portion 104. However, in other embodiments, the hollow of the retainer 144 can have a diameter that varies along the length of the retainer 144.

Also, the retainer 144 can include a contiguous slit 146 that can extend the entire length of the retainer 144 that enables the spring member 145 to be radially or circumferentially compressed to a diameter smaller than the uncompressed diameter of the retainer 144. The depicted retainer 144 can include a slit 146 that can extend in a direction generally parallel to the longitudinal length of the retainer 144 and the axis 107. In other embodiments, the slit 146 can be of any contiguous shape that extends the entire longitudinal length of the retainer 144, including but not limited to slanted, angled, stepped, etc. The slit 146 also need not have a uniform opening dimension throughout, provided that the minimum opening dimension of the slit 146 is sufficient to enable the spring member 145 to be radially compressed from an uncompressed diameter to a diameter sufficiently small to fit in a bore 304, such as the one shown in FIGS. 11-16. The retainer 144 can be made from any material, including, but not limited to, spring steel, that enables the retainer 144 to expand outwardly to radially exert outward force when the diameter of the retainer 144 is reduced to less than the uncompressed diameter.

The diameter of the bore 304 into which the grading pick 100 can be inserted can be smaller than the uncompressed diameter of the retainer 144, such that the grading pick 100 can be retained within the bore 304 by the frictional force resulting from the radially outward force exerted on the walls of the bore 304 by the retainer 144.

Referring to FIGS. 1-5, the polygonal portion 106 can be integrally formed with or mechanically coupled with a part of the head portion 102, a part of the shank portion 104, or some combination of the aforementioned. The polygonal portion 106 can be formed with a shape that allows it to mate, couple, or engage with a tool, such as a hand wrench, a pneumatic wrench, a crescent-type wrench, a combination wrench, a socket for a wrench, or some other tool that can mate, couple, or engage the polygonal portion 106 or at least a portion of an outer perimeter of the polygonal portion 106 so that the polygonal portion 106 can be rotated. An outermost perimeter of the polygonal portion 106 can have one or more substantially planar faces 162. The one or more substantially planar faces 162 can be adapted to mate, couple, or engage with at least a portion of a tool, for example, the jaws of a wrench.

Figure 4:
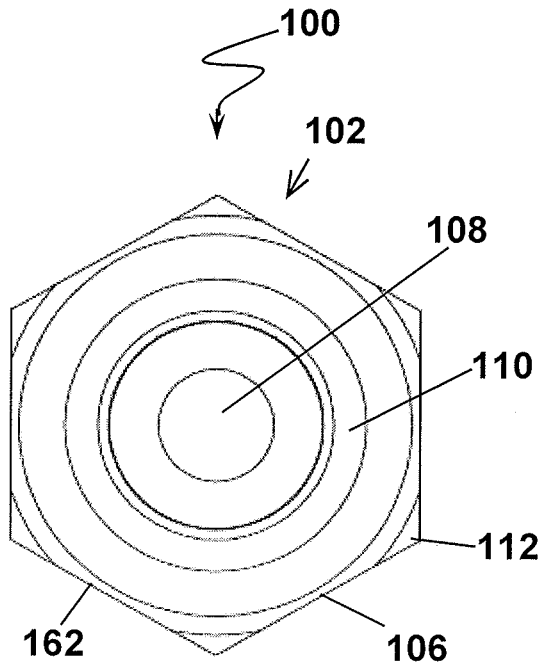
FIG. 4 is a front elevation view of the rotatable grading pick shown in FIG. 1.
Figure 5:
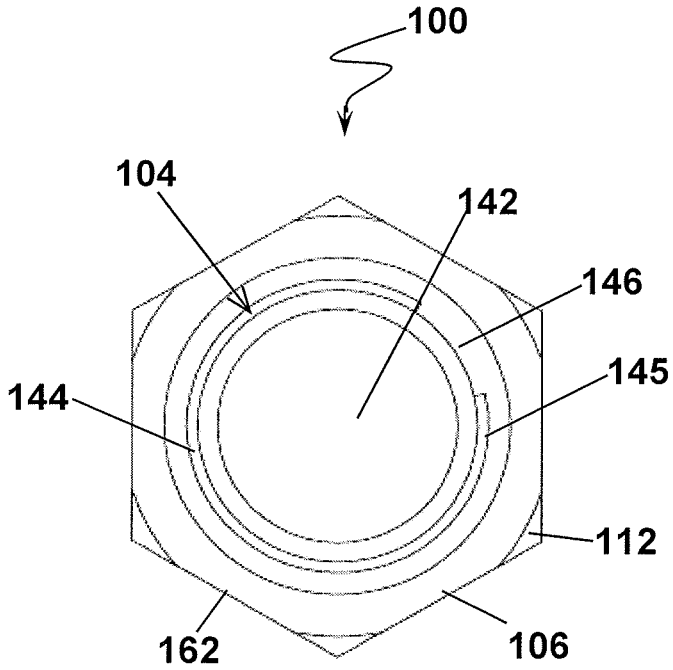
FIG. 5 is a rear elevation view of the rotatable grading pick shown in FIG. 1.
Figure 6:
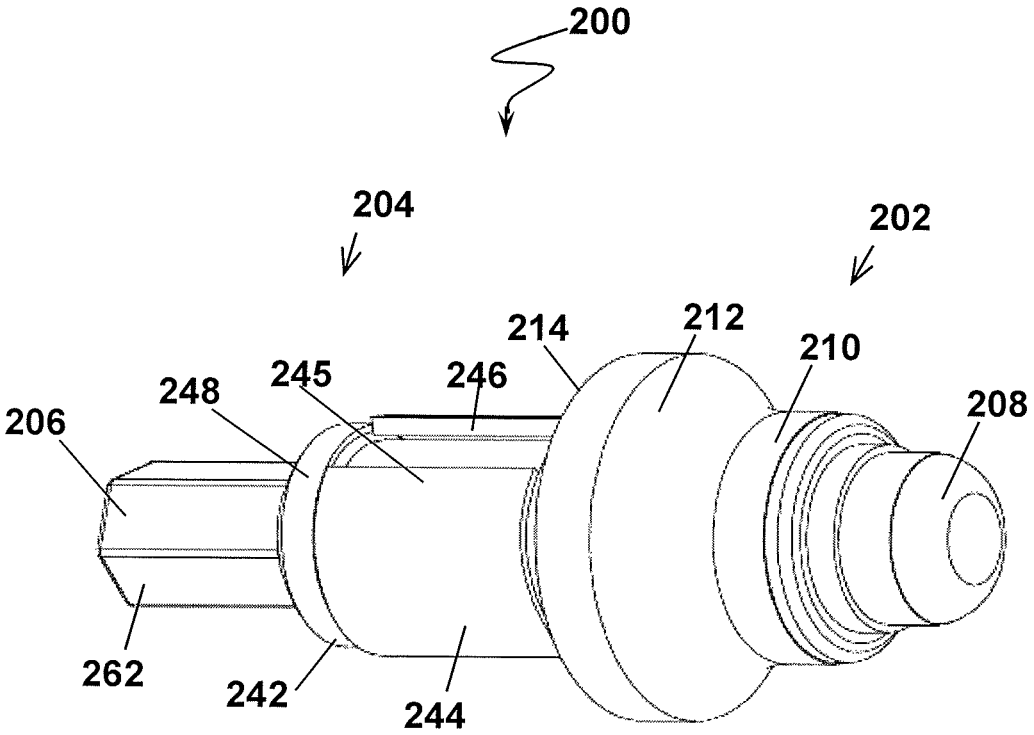
FIG. 6 is a perspective view of a rotatable tool grading in accordance with another exemplary embodiment of the invention.
Figure 7:
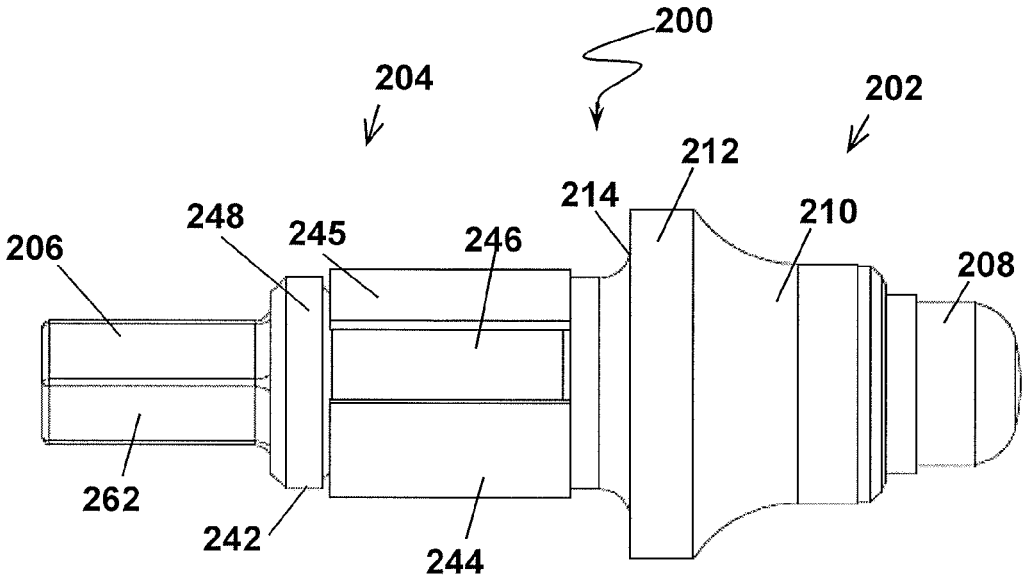
FIG. 7 is a plan view of the rotatable tool grading shown in FIG. 6.
Figure 8:
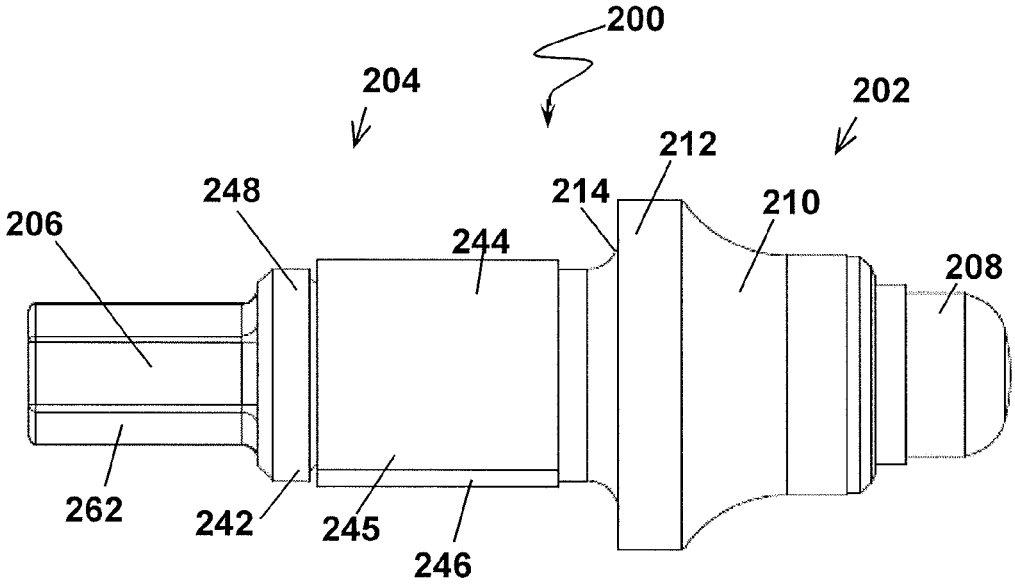
FIG. 8 is another plan view of the rotatable grading pick shown in FIG. 6.

In the embodiment shown in FIGS. 1-5, the shoulder region 112 of the head portion 102 can include the polygonal portion 106. The shoulder region 112 with the polygonal portion 106 can include six substantially planar faces 162, as best shown in FIGS. 4-5. The six planar faces 162 can meet at two edges so that the perimeter of the polygonal portion 106 forms a generally regular hexagonal shape, as shown in FIGS. 4-5. A wrench can simultaneously engage at least two opposite faces 162 to rotate the polygonal portion 106 which thereby causes the shoulder region 112 to rotate and thus causes the head portion 102 and the shank portion 104 which extends from the head portion 102 to rotate. When the shank portion 104 is rotated, some or all of any debris between the shank portion 104 and the retainer 144 can be loosened and then fall away from the shank portion 104 and the retainer 144. The number of faces 162 is not meant to limit the invention. In other embodiments, there may be more or less than the six faces 162 shown in FIGS. 1-5. For example, there may be four faces 162 so that the perimeter of the polygonal portion 106 forms a substantially square shape or eight faces 162 so that the perimeter of the polygonal portion 106 forms a generally octagonal shape. Also, as shown in FIGS. 1-5, the polygonal portion 106 can be chamfered.

Referring to FIGS. 6-10, another exemplary grading pick 200 is shown. The second exemplary grading pick 200 can include a head portion 202 and a shank portion 204 extending from the head portion 202. Unlike the exemplary embodiment shown in FIGS. 1-5, the grading pick 200 can include a polygonal portion 206 formed at or extending from the end 242 of the shank portion 204 and, at least, partially formed with a polygonal shape adapted to engage a tool, such as a hand wrench, a pneumatic wrench, a crescent-type wrench, a combination wrench, a socket for a wrench, or some other tool that can engage the polygonal portion 206 or engage at least a portion of an outer perimeter of the polygonal portion 206 so that the polygonal portion 206 can be rotated.

Referring to FIGS. 6-9, the head portion 202 can include, for example, a tip 208, a shoulder region 212, and a side surface 210 extending between the tip 208 and the shoulder region 212. The tip 208 can be disposed at the front of the head portion 202 and the shoulder region 212 can be disposed at the opposite end of the head portion 202.

The tip 208 can be substantially similar to the tip 108. The tip 208 can be formed integrally with the head portion 202 or made separately and then mechanically coupled to the head portion 202. If the tip 208 is formed separately, the head portion 202 can include a seat for receiving the tip 208 at a front end of the head portion 202. The tip 208 can be made from a suitably hard material, such as tungsten carbide or cemented carbide, such as 6-12 wt. % Co with the balance being WC.

The side surface 210 extending between the tip 208 and the shoulder region 212 can be substantially similar to the side surface 110 shown in FIGS. 1-5. In the embodiment shown in FIGS. 6-9, the side surface 210, unlike the side surface 110 shown in FIGS. 1-5, can have a different form. The side surface 210 can taper away from the tip 208 and then can flare radially outward to meet the shoulder region 212.

Figure 9:
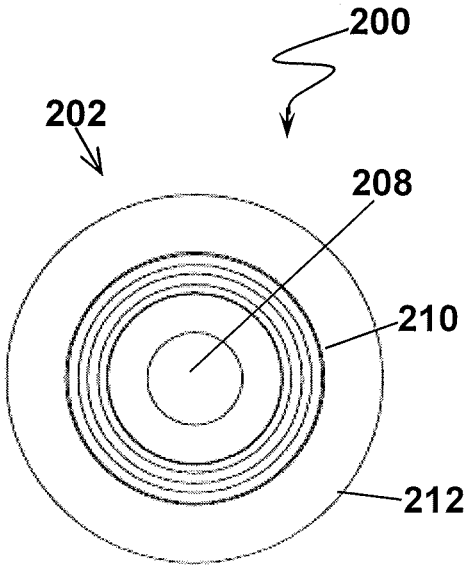
FIG. 9 is a front elevation view of the rotatable grading pick shown in FIG. 6.
Figure 10:
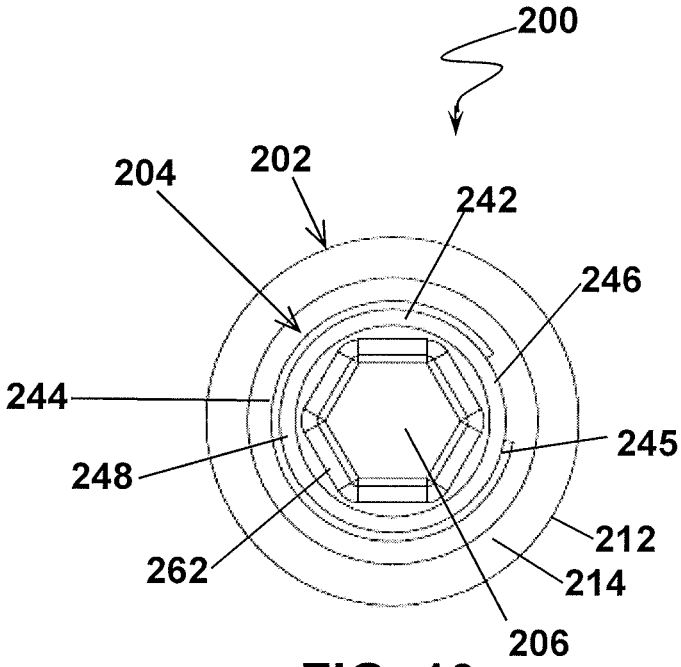
FIG. 10 is a rear elevation view of the rotatable grading pick shown in FIG. 6.
Figure 11:
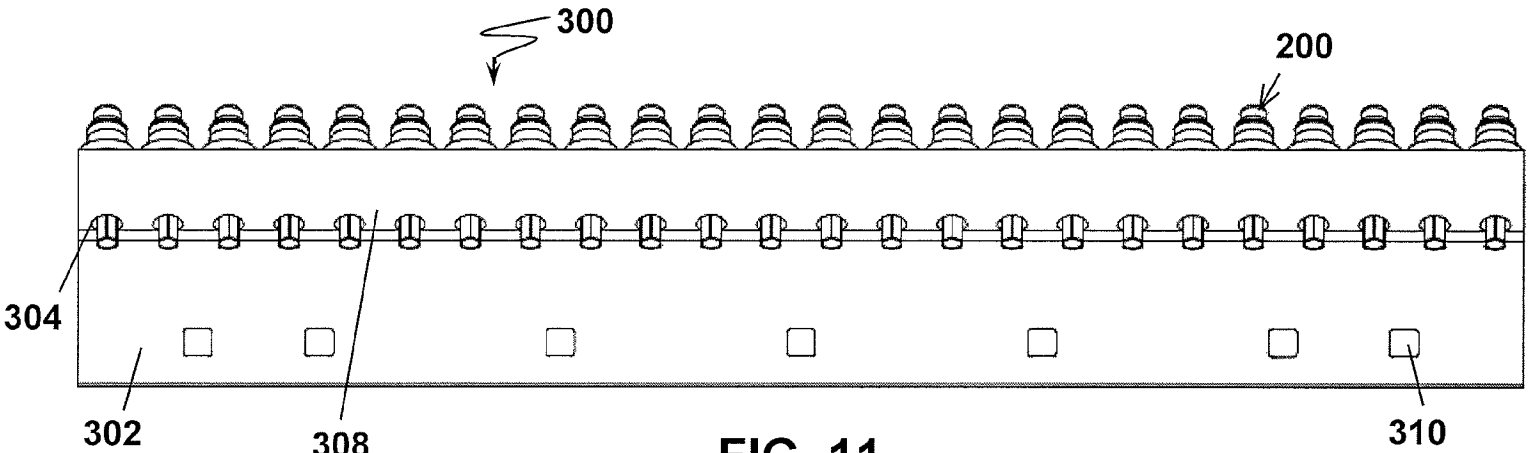
FIG. 11 is a rear elevation view of a holder containing the rotatable grading pick shown in FIG. 6.
Figure 12:
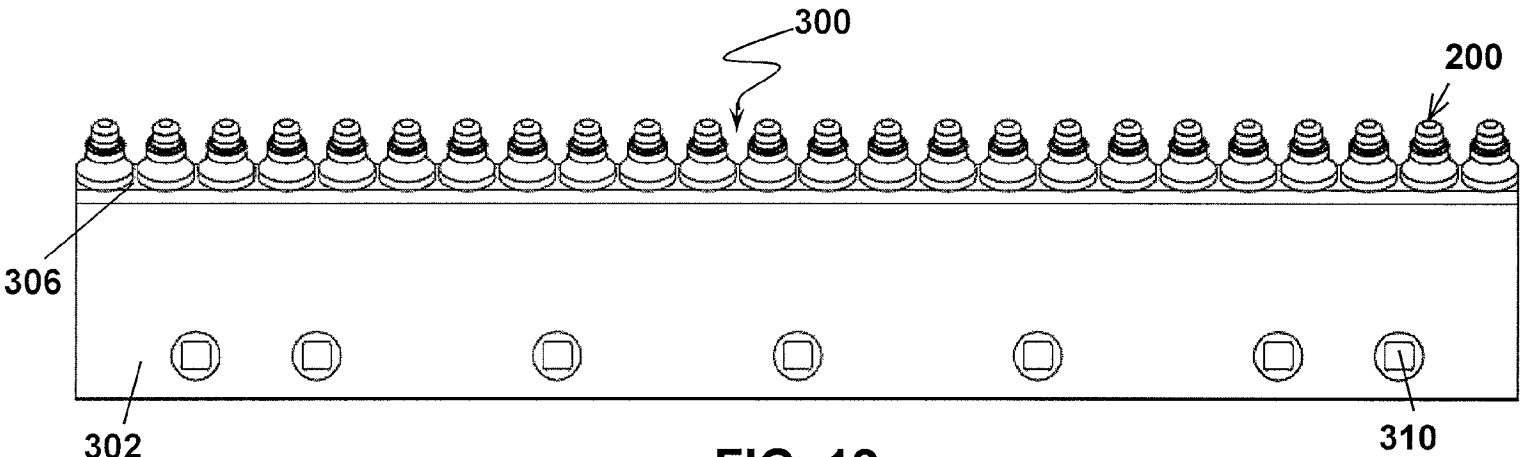
FIG. 12 is a front elevation view of the holder shown in FIG. 11.
Figure 13:
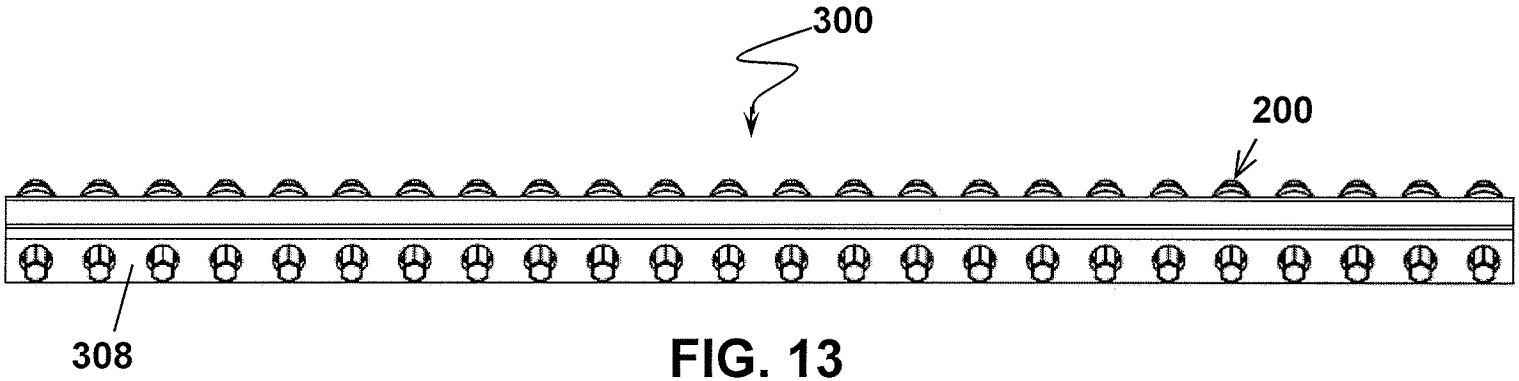
FIG. 13 is a bottom plan view of the holder shown in FIG. 11.
Figure 14:
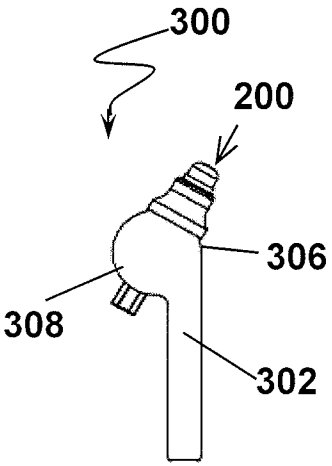
FIG. 14 is a side elevation view of the holder shown in FIG. 11.
Figure 15:
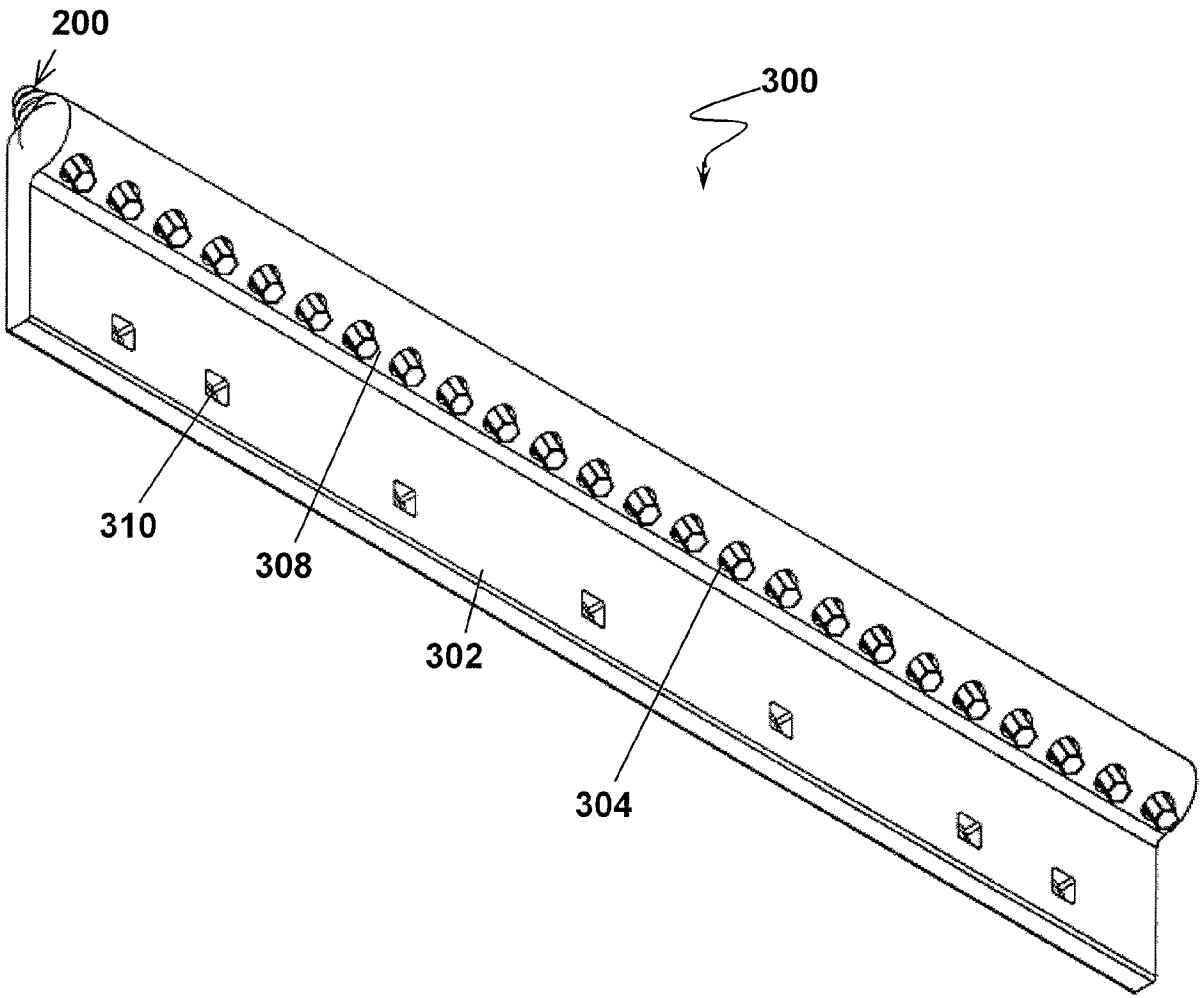
FIG. 15 is a rear perspective view of the holder shown in FIG. 11.
Figure 16:
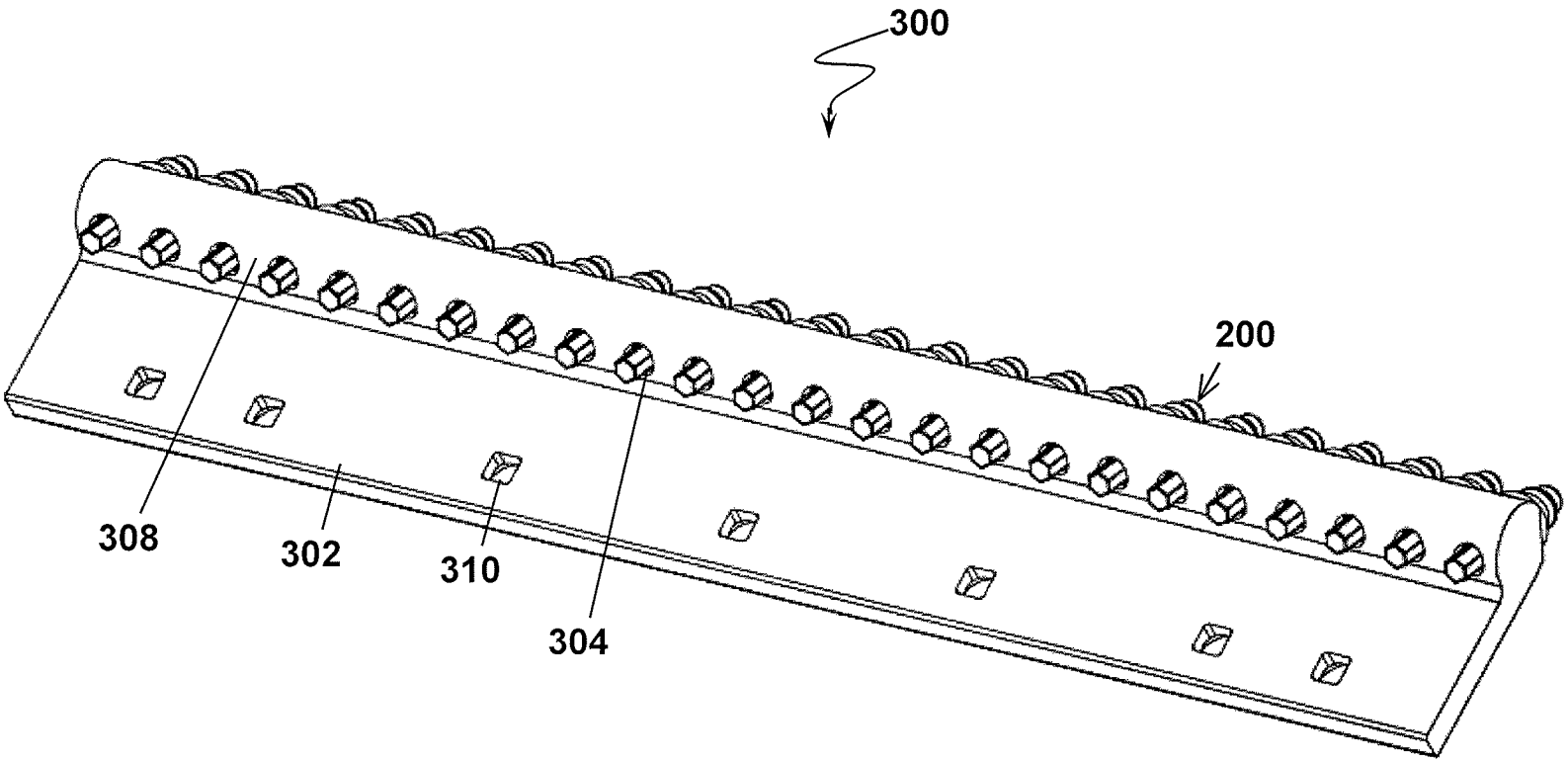
FIG. 16 is a rear opposite perspective view of the holder shown in FIG. 11.
Figure 17:
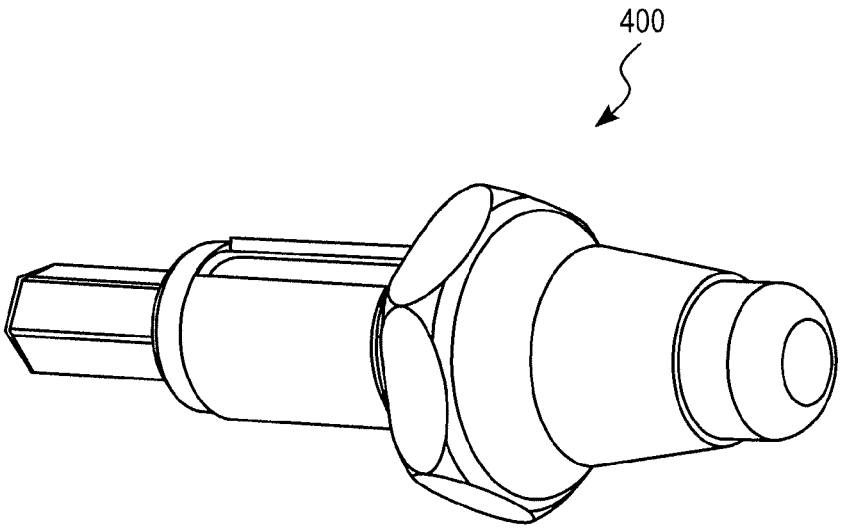
FIG. 17 is a perspective view of a rotatable tool grading in accordance with a further exemplary embodiment of the invention.

The shoulder region 212 can provide a rearward facing surface 214 from which the shank portion 204 can extend. The shoulder region 212 can include a puller groove in place of or in addition to a puller groove on the side surface 210. The shoulder region 212, as shown in FIGS. 9-10, can have an outermost perimeter having a substantially circular shape. The shoulder region 212 can extend rearward with a generally constant diameter.

Referring to FIGS. 6-8 and 10, the shank portion 204 can extend rearwardly from the surface 214 of the head portion 202. In alternate embodiments, a part of the shank portion 204 immediately adjacent to the shoulder region 212 may have an enlarged diameter portion that can be used as a washer seat. In other embodiments, the shank portion 204 may include a reduced diameter portion for accommodating a reduced diameter portion of a retaining element or for receiving a washer. The shank 204 can include additional features, such as an annular recess, a circumferential channel, or some other depression that can be used for retaining the grading pick 200 or for receiving another component or tool.

In the embodiment shown, the shank portion 204 can extend from the surface 214 of the shoulder region 212. The shank portion 204 can include an end 242 that is opposite the tip 208 of the grading pick 200. A retainer 244 can be disposed substantially between the end 242 of the shank portion 204 and the shoulder region 212 of the head portion 202.

The retainer 244 can be disposed about at least a part of the shank portion 204. The retainer 244 can be substantially similar to the retainer 144 shown in FIGS. 1-5. The retainer 244 may not be in friction fit contact with the shank portion 204 of the grading pick 200. However, the retainer 244 can be mated to the shank portion 204 to limit axial movement and can include a retaining feature for retaining the grading pick 200. The retainer 244 can include a spring member 245 that provides the retainer 244 with an uncompressed diameter or free diameter. The retainer 244 can also have an axial length and a thickness. In the embodiment shown, the retainer 244 can have a generally cylindrical, tubular form with a hollow extending through the retainer 244. The hollow of the retainer 244 can be sized to substantially envelope the shank portion 204. However, in other embodiments, the hollow of the retainer 244 can have a diameter that varies along the length of the retainer 244.

Also, the retainer 244 can include a contiguous slit 246 that can extend the entire length of the retainer 244 that can enable the spring member 245 to be radially or circumferentially compressed to a diameter smaller than the uncompressed diameter. The depicted retainer 244 can include a slit 246 that can extend in a direction generally parallel to the longitudinal length of the retainer 244. In other embodiments, the slit 246 can be of any contiguous shape that can extend the entire longitudinal length of the retainer 244, including but not limited to slanted, angled, stepped, etc. The slit 244 also need not have a uniform opening dimension throughout, provided that the minimum opening dimension of the slit 244 is sufficient to enable the spring member 245 to be radially compressed from an uncompressed diameter to a diameter sufficiently small to fit in a bore 304, such as the one shown in FIGS. 11-16. The retainer 244 can be made from any material, including, but not limited to, spring steel, that can enable the retainer 244 to expand outwardly to radially exert outward force when the diameter of the retainer 244 is reduced to less than the uncompressed diameter.

The diameter of the bore 304 into which the grading pick 200 is inserted can be smaller than the uncompressed diameter of the retainer 244, such that the grading pick 200 can be retained within the bore 304 by the frictional force resulting from the radially outward force exerted on the walls of the bore 304 by the retainer 244.

The shank portion 204, the retainer 244, or both can utilize a friction fit feature or a physical restraining feature. For example, in some embodiments, the shank portion 204 can include tabs, bumps, convex portions, concave portions, or some other interlocking mechanical parts so that retainer 244 is coupled with the shank portion 204. In the embodiment shown in FIGS. 6-10, the shank portion 204 can include an enlarged diameter portion 248 disposed near the end 242. The diameter of the enlarged diameter portion 248 can be larger than an inner diameter of the retainer 244 so that the shank portion 204 can restrain the retainer 244.

Referring to FIGS. 6-10, the polygonal portion 206 can be integrally formed with or mechanically coupled with a part of the shank portion 204. The polygonal portion 206 can be formed with a shape that allows the polygonal portion 206 to mate, couple, or engage with a tool, such as a hand wrench, a pneumatic wrench, a crescent-type wrench, a combination wrench, a socket for a wrench, or some other tool that can mate, couple, or engage the polygonal portion 206 or at least a portion of an outer perimeter of the polygonal portion 206 so that the polygonal portion 206 can be rotated. An outermost perimeter of the polygonal portion 206 can have one or more substantially planar faces 262. The one or more substantially planar faces 262 can be adapted to mate, couple, or engage with at least a portion of the tool, for example, the jaws of a wrench.

In the embodiment shown in FIGS. 6-10, the polygonal portion 206 can extend from the end 242 of the shank portion 204. The polygonal portion 206 can include six substantially planar faces 262, as best shown in FIGS. 6-8 and 10. The six planar faces 262 can meet at two transitional edges so that the perimeter of the polygonal portion 206 can form a generally regular hexagonal shape, as shown in FIG. 10. A wrench can simultaneously engage at least two opposite faces 262 to rotate the polygonal portion 206 which thereby causes the shank portion 204 to rotate. The number of faces 262 is not meant to limit the invention. In other embodiments, there may be more or less than the six faces 262 shown in FIGS. 6-10. For example, there may be four faces 262 so that the perimeter of the polygonal portion 206 forms a substantially square shape or eight faces 262 so that the perimeter of the polygonal portion 206 forms a generally octagonal shape. Also, as shown in FIGS. 6-10, the polygonal portion 206 can be chamfered so that the edges between adjacent planar faces 262 do not form an acute angle and instead form a generally rounded edge.

As seen in FIGS. 1-10, the grading pick has a longitudinal axis and has both rotational symmetry and reflection symmetry along the longitudinal axis.

As shown in FIGS. 11-16, the grading pick 100 or 200 can be used with a holder 300 that can be included in a tool and block assembly. An exemplary embodiment of the holder 300 can include a body 302 having a bore 304 extending axially from a first side 306 to a second side 308. An inner surface of the bore 304 can be complimentarily shaped to receive the outer surface of the retainer 144 or 244 or some other retainer or sleeve. At least portions of the inner surface of the bore 304 can form a friction fit with the retainer 144 or 244 or some other retainer or sleeve. For example, because the retainer 144 or 244 can be circumferentially compressible, the retainer 144 or 244 can compress to fit inside the bore 304, and the elastic properties of the retainer 144 or 244 can provide for friction retention of the retainer 144 or 244 in the bore 304. In this compressed, friction-retention state, the relationship of the sizes of the diameters of the inner surface of the retainer 144 or 244 relative to the shank portion 104 or 204 can remain such that the grading pick 100 or 200 can be rotatable relative to the retainer 144 or 244, which is itself substantially stationary or stationary relative to the body 302 of the holder 300 by operation of the friction fit. In yet other embodiments, the inner surface of the bore 304 can have internal grooves or some other surface feature for coupling to the retainer 144 or 244.

Exemplary embodiments of the grading pick 100 or 200 can be mounted in at least one of the bores 304 of the holder 300, with or without the use of a sleeve. In the depicted embodiment, one of several grading picks 200 is shown mounted in each of the bores 304 of the holder 300. In other embodiments, the grading pick 100 can be placed in the each of the bores 304, or a combination of grading picks 100 and 200 can be positioned in the bores 304 so that the holder 300 can include both grading picks 100 and 200.

Installation of the grading pick 100 or 200 into the holder 300 can be by any suitable means. In an exemplary embodiment, an operator can use a standard dead-blow hammer to knock the grading pick 100 or 200 into the bore 304. When installed, the retainer 144 or 244 can be positioned tightly against the bore 304 and can seal out dust and fines from grinding into the wall of the bore 304. However, fines may approach the retainer 144 or 244 between the shank portion 104 or 204 and the inner surface of the retainer 144 or 244. Those fines can be substantially removed by rotating the grading pick 100 or 200 by rotating the polygonal portion 106 or 206. The grading pick 100 or 200 and the retainer 144 or 244 can also be replaced with new parts.

The holder 300 can subsequently be formed as part of a tool and block assembly that can be mounted on a machine for use. The body 302 can be adapted for mounting to a road grading machine, mining machine, construction machine, tunneling machine, trenching machine or excavating machine. In the embodiment shown, the body 302 can include one or more couplings 310. The depicted couplings 310 are apertures adapted to receive a mounting so that the body 302 can be mated to a tool and block assembly or a machine.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A tool and block assembly, comprising:

a holder including a body having a bore extending axially from a first side to a second side; and a grading pick rotatably mounted in the bore of the block, the grading pick including a head portion, a shank portion extending rearwardly from the head portion, and a first polygonal portion and a second polygonal portion disposed on the grading pick, wherein the shank portion of the grading pick includes the first polygonal portion, wherein the first polygonal portion of the shank extends from the bore rearwardly past the second side of the body to expose the first polygonal portion, wherein a circumference of a cross-section of the first polygonal portion has a shape of a first polygon, wherein the head portion of the grading pick further comprises a shoulder region that includes the second polygonal portion and a circumference of a cross-section of the second polygonal portion has a shape of a second polygon, and wherein the grading pick has a longitudinal axis and has both rotational symmetry and reflection symmetry along the longitudinal axis.

2. The tool and block assembly of claim 1, wherein the first polygonal portion further comprises a plurality of planar surfaces, each of the plurality of planar surfaces disposed adjacent another one of the plurality of planar surfaces.

3. The tool and block assembly of claim 1, wherein the shape of the first polygon is hexagonal shaped.

4. The tool and block assembly of claim 3, wherein the shape of the second polygon is hexagonal shaped.

5. The tool and block assembly of claim 1, further comprising a retainer disposed between the grading pick and the bore.

6. The tool and block assembly of claim 1, wherein the shape of the second polygon is hexagonal shaped.

7. The tool and block assembly of claim 1, wherein the grading pick further includes a puller groove on at least one of the shoulder region and a side surface of the head portion.

8. A road grading machine, comprising:

a block assembly; and a grading pick rotatably mounted to the block assembly, the grading pick including a head portion, a shank portion extending rearwardly from the head portion, and a first and second polygonal portions disposed on the grading pick, wherein the block assembly includes a body having a bore extending axially from a first side to a second side;

wherein the shank portion of the grading pick includes the first polygonal portion, wherein the shank of the grading pick is rotatably mounted in the bore of the block with the first polygonal portion extending from the bore rearwardly past the second side of the body to expose the first polygonal portion, wherein the head portion of the grading pick further comprises a shoulder region and the shoulder region includes the second polygonal portion, wherein a circumference of a cross-section of the shank portion has a shape of a first polygon, wherein a circumference of a cross-section of the shoulder region has a shape of a second polygon, and wherein the grading pick has a longitudinal axis and has both rotational symmetry and reflection symmetry along the longitudinal axis.

9. The road grading machine of claim 8, wherein each of the first and second polygonal portions further comprises a plurality of planar surfaces, each of the plurality of planar surfaces disposed adjacent another one of the plurality of planar surfaces.

10. The road grading machine of claim 8, wherein the shape of the first polygon is hexagonal shaped.

11. The road grading machine of claim 10, wherein the shape of the second polygon is hexagonal shaped.

12. The road grading machine of claim 8, further comprising a retainer disposed between the grading pick and the block assembly.

13. The road grading machine of claim 8, wherein the shape of the second polygon is hexagonal shaped.

14. The road grading machine of claim 8, wherein the grading pick further includes a puller groove on at least one of the shoulder region and a side surface of the head portion.

* * * * *